United States Patent [19]

Scherer

[11] 4,413,976

[45] Nov. 8, 1983

[54] IGNITER FOR A GAS BURNER

[75] Inventor: Richard M. Scherer, Niles, Mich.

[73] Assignee: Southbend Escan Corporation, South Bend, Ind.

[21] Appl. No.: 264,111

[22] Filed: May 15, 1981

[51] Int. Cl.[3] ..... F23D 13/12

[52] U.S. Cl. ..... 431/278; 431/328

[58] Field of Search ..... 431/328, 329, 278, 284

[56] References Cited

U.S. PATENT DOCUMENTS

| | | | |
|---|---|---|---|
| 2,073,448 | 3/1937 | Fruth et al. | 431/284 |
| 2,474,547 | 6/1949 | Patch | 431/278 |
| 3,434,791 | 3/1969 | Kanekichi | 431/328 |
| 3,681,002 | 8/1972 | Kweller et al. | 431/328 |
| 4,326,843 | 4/1982 | Smith | 431/328 |

*Primary Examiner*—Carroll B. Dority, Jr.

*Attorney, Agent, or Firm*—James D. Hall

[57] ABSTRACT

An igniter which is for a gas burner and which serves to produce a pilot flame at the outer surface of the burner face.

The igniter includes a tube which extends through the housing chamber and the burner and terminates adjacent to the burner face. Pilot gas passes through the tube where gas ignition occurs at the burner surface.

2 Claims, 4 Drawing Figures

IGNITER FOR A GAS BURNER

SUMMARY OF THE INVENTION

This invention relates to gas burners and will have particular but not limited application to the igniter for radiant type gas burners.

A problem has existed for many years in the radiant gas burner industry regarding methods of ignition of such burners. Radiant gas burners normally burn between temperatures of 1400 and 1600 degrees Fahrenheit. Additionally, the air required for combustion within the radiant gas burners needs to be 100 percent primary air which serves to dilute the gas mixture at the burner tiles. Ignition by means of electronic or spark lighting has not been particularly effective due to the inability of obtaining a hot enough spark to ignite the lean gas mixture within the burner. Gas pilots which have been used with radiant gas burners are positioned exteriorally of the burner with the spacing between the pilot and the burner being critical and difficult to maintain. The high heat created at the burner tile surface causes the pilot flame to divert and even sometimes extinguishes the pilot.

In this invention, ignition of the radiant gas burner is accomplished by positioning a pilot at the outer surface of the burner tile. This placement of the pilot serves to provide a reliable and efficient means of igniting the gas burner. Fewer components of the igniter are required, which simplifies servicing. Assembly and location of the igniter need not be exacting as is presently required for pilots. Also, with the igniter of this invention a smaller pilot flame is needed, thus conserving gas consumption. By designing the igniter with a ceramic burner tip, the igniter withstands the high temperatures of the burner and has a much longer useful life than the current steel pilots being utilized and positioned at the exterior of the burner.

Accordingly, it is an objective of this invention to provide an improved igniter for a gas burner.

Another object of this invention is to provide an immediate and reliable igniter for radiant gas burners Still another object of this invention is to provide an economical, simply installed igniter for a radiant gas burner.

Still another object of this invention is to provide a pilot for a radiant gas burner which minimizes gas usage.

Other objects of this invention become apparent upon reading the following description.

DESCRIPTION OF THE PREFERRED EMBODIMENTS

The preferred embodiments illustrated are not intended to be exhaustive or to limit the invention to the precise forms disclosed. They are chosen and described in order to best explain the principles of the invention and to enable others skilled in the art to utilize the invention.

Figure 1:
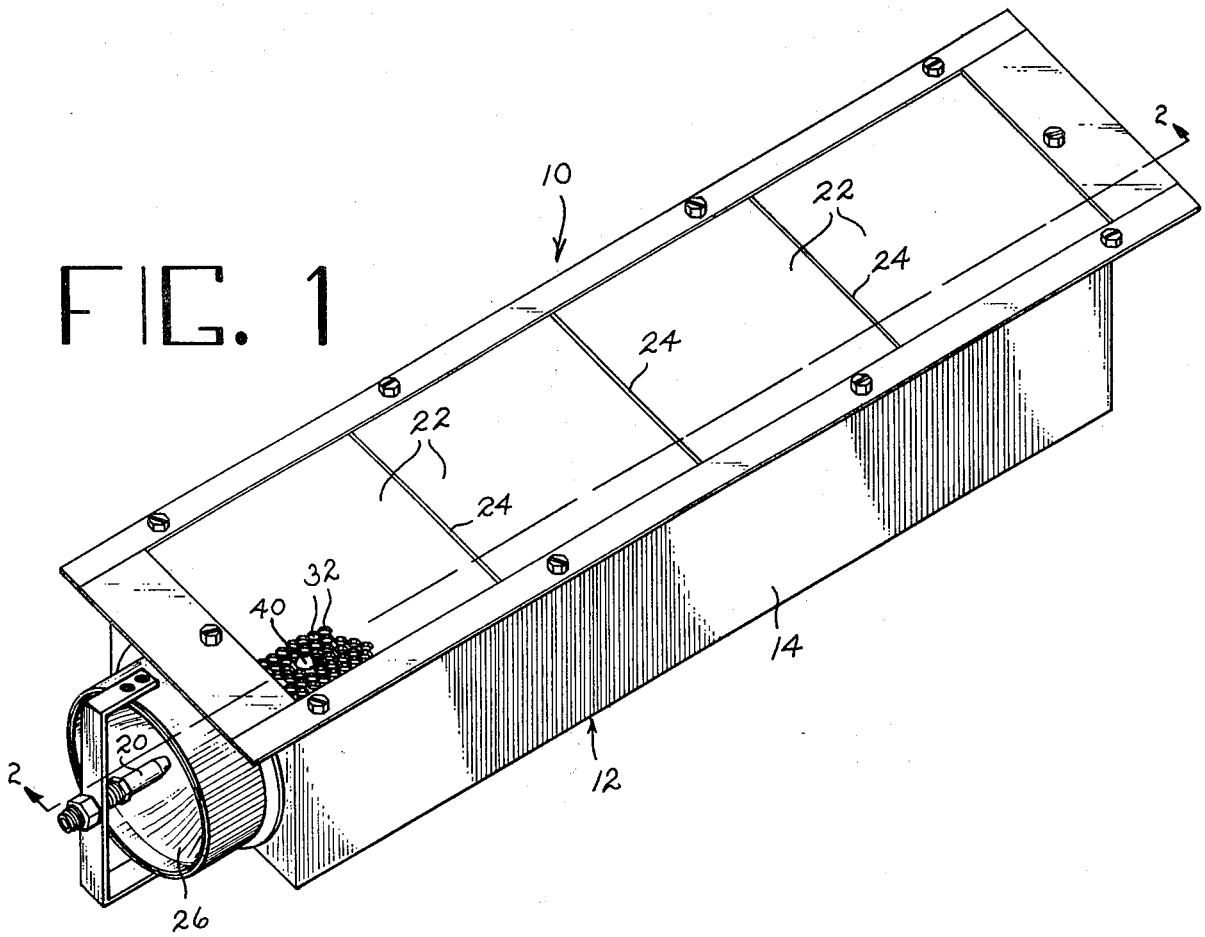
FIG. 1 is a perspective view of a radiant gas burner.
Figure 2:
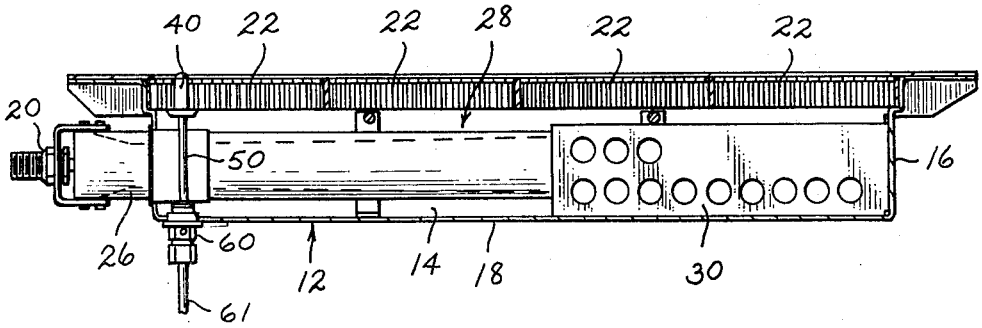
FIG. 2 is a longitudinal sectional view taken along line 2—2 of FIG. 1 showing one embodiment of the invention.
Figure 3:
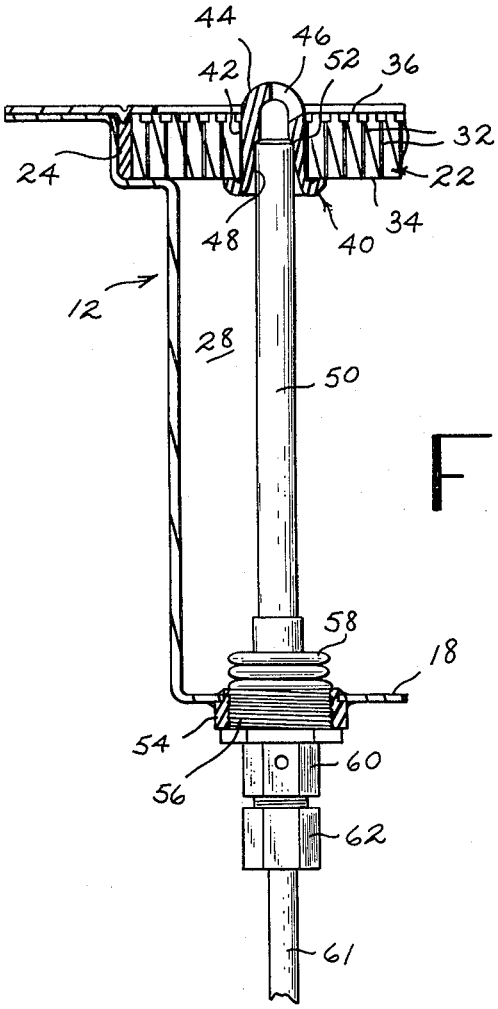
FIG. 3 is a detailed view of the embodiment of FIG. 2.

In FIGS. 1–3, one embodiment of the invention is shown. Burner 10 includes a housing 12 having sidewalls 14, an end wall 16, and a base wall 18. The end of housing 12 opposite end wall 16 receives a venturi 26 and a gas inlet nozzle 20. A plurality of tiles 22 is carried by housing 12 in a spaced relationship from base wall 18 to form a chamber 28 within the housing. Packing 24 extends around each tile 22 to provide a seal for the gas and air mixture utilized within burner 10. Venturi 26 extends within housing chamber 28 and normally includes a baffle 30 which distributes and reverses the direction of gas flow as it exits from the venturi within chamber 28 of the housing to fill chamber 28. Housing 12 and venturi 26 are normally formed of a steel or a similar metal construction, and tiles 22 are formed of a ceramic material. Each tile 22 includes a plurality of openings 32 which extend from the inner surface 34 to the outer surface 36 of the tile. Gas enters venturi 26 through nozzle 20 with the venturi serving to draw air into chamber 28 where it mixes with the gas. The air and gas mixture emerges from the burner through tile openings 32 with the mixture being burned at the outer surface 36 of the tiles in a commonly known manner. As thus far described, burner 10 is of a common, commercially known construction.

The embodiment of the igniter of this invention shown in FIGS. 1–3 includes a burner tip 40. A bore 42 is formed in one of the burner tiles 22, preferably at one end corner of the burner. Tip 40 fits snugly into bore 42 and is connected to the tile, such as by a press fit or a high temperature cement. The nozzle end 44 of tip 40, which includes a gas emission slot 46, protrudes slightly beyond the outer surface 36 of the tile. An axial bore 48 is formed in tip 40, extending from the nozzle end to the opposite end of the tip where it opens into chamber 28 of the burner. Tip 40 is preferably formed of a ceramic composition, such as a combination of aluminum, silicone and magnesium.

The igniter of FIGS. 1–3 further includes a tube 50 which extends through base wall 18 of burner housing 12 and into bore 48 of tip 40. Tube 50 is preferably of a steel or similar metal construction. A shoulder 52 is formed within tip bore 48 near the nozzle end. Tube 50, when assembled within burner 10, abuts shoulder 52 of tip 40 so as to locate the tube relative to the tip. To connect tube 50 to burner housing 12, a collar 54, which is internally threaded, is brazed or otherwise suitably attached to base wall 18 of the housing about the opening through which tube 50 projects. Tube 50 can be provided with a threaded flange 56 which is threadably received within collar 54 when the tube is assembled and connected to housing 12. In order to provide a firm, slightly compressive fit of tube 50 against shoulder 52 of tip bore 42, the tube is provided with a bellows section 58. Bellows section 58 accomodates slight longitudinal movement of tube 50 relative to tip 40 and base wall 18 of housing 12. Additionally, by providing the expandable bellows section 58 for tube 50, expansion of the tube can be accommodated during burner usage. An aspirator 60 is also connected to tube 50 outside of housing base wall 18. A gas supply tube 61 is connected to igniter tube 50 by a tightening nut 62 at aspirator 60.

Pilot light gas is furnished to tip 40 through tube 50 so as to provide a small pilot flame about nozzle end 44 of the tip at the outer surface 36 of burner tile 22. By so locating the pilot flame directly within the flame area of the radiant burner tile, the burner can be ignited nearly immediately upon the introduction of gas into housing chamber 28. Also the pilot flame from tip 40 is not particularly susceptible to blowout during burner usage.

Figure 4:
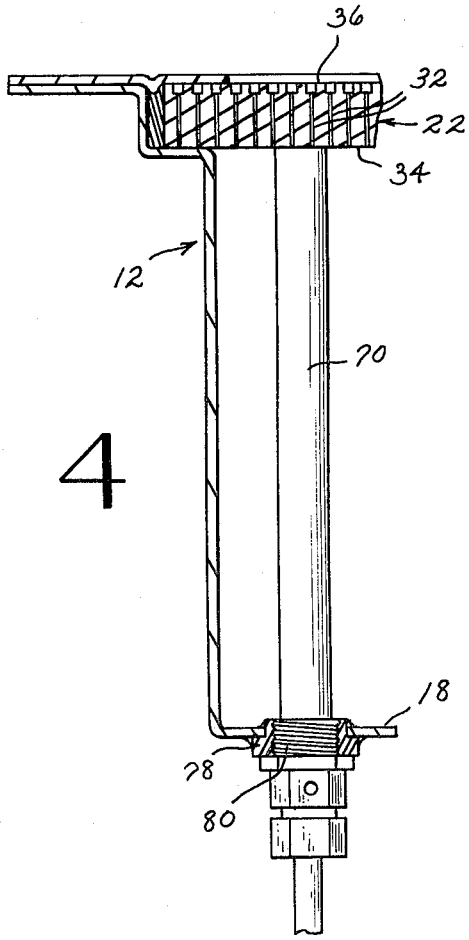
FIG. 4 is a detailed view of a second embodiment of this invention.

The embodiment of the igniter shown in FIG. 4 is similar in construction to the igniter described in FIGS. 1–3 in that the pilot flame is introduced and maintained at the outer surface 36 of burner tile 22. In this embodiment, a tip is not utilized, but instead tube 70 of the igniter extends through base wall 18 of burner housing 12 and terminates next to inner surface 34 of the tile 22, again preferably in one corner of the burner. Tube 70 is preferably of a steel or similar metal construction. The open end of tube 70 is located under one or more openings 32 in tile 22. A gas supply tube 74 is secured through aspirator 76 to tube 70. The pilot gas is emitted from tube 74 through openings 32 in tile 22 with the pilot flame being located at the outer surface 36 of the tile. While one or more separate openings may be formed through tile 22 in alignment with tube 70 to accommodate pilot gas flow through the tile for ignition of the pilot light at tile outer surface 36, it has been found that the normal openings 32 in the tile suffice for this purpose quite adequately. A threaded collar 78 is secured to base wall 18 of burner housing 12 and receives a threaded interconnecting flange 80 of tube 70. The manner of burner ignition utilizing tube 70 as the pilot is substantially the same as the previously described with respect to the igniter of tube 50 described with respect to the embodiment of FIGS. 1–3.

It is to be understood that the invention is not limited to the details above given but may be modified within the scope of the appended claims.

What I claim is:

1. A gas burner including tile having inner and outer surfaces with multiple openings extending through the tile from the inner to the outer surfaces thereof, a housing associated with said tile and defining a chamber with said tile inner surface forming one wall of said housing chamber, means for introducing gas into said housing chamber, and means for igniting said gas to produce radiant heat at said tile outer surface, the improvement wherein said gas igniting means includes a nozzle secured within one of said openings, tube means adapted for connection at one end to a gas source extending within said housing chamber and seated at its other end in said nozzle for supplying gas to a pilot flame at said tile outer surface, said tube means as it extends into said housing chamber including heat expandable bellows parts to accommodate heat expansion of the tube means within said housing chamber during burner usage for the purpose of maintaining the seat of said tube means other end in said nozzle, whereby gas introduced into said housing chamber will be ignited at said tile outer surface.

2. The radiant burner of claim 1 wherein said nozzle has a gas-emitting slot formed therein adjacent said tile outer surface, a shoulder formed in said nozzle, said tube means other end seated against said shoulder.

* * * * *